US006447332B1

(12) United States Patent
Djian

(10) Patent No.: US 6,447,332 B1
(45) Date of Patent: Sep. 10, 2002

(54) ADAPTER FOR USE IN EGT MEASUREMENT OF A JET ENGINE

(75) Inventor: Israel Djian, Jerusalem (IL)

(73) Assignee: Israel Aircraft Industries Ltd., Lod (IL)

( * ) Notice: Subject to any disclaimer, the term of this patent is extended or adjusted under 35 U.S.C. 154(b) by 16 days.

(21) Appl. No.: 09/609,406

(22) Filed: Jul. 3, 2000

(30) Foreign Application Priority Data

Jul. 5, 1999 (IL) ..... 130799

(51) Int. Cl.[7] ..... H01R 13/73

(52) U.S. Cl. ..... 439/564; 403/201; 374/208; 73/866.5

(58) Field of Search ..... 439/573, 564, 439/563, 569; 73/866.5; 374/144, 208; 403/335–337, 256–257, 187–188, 194, 199, 201

(56) References Cited

U.S. PATENT DOCUMENTS 3,357,421 A * 12/1967 Hatch ..... 73/866.5
3,584,509 A * 6/1971 Compton et al. ..... 374/144
4,117,257 A * 9/1978 Thomas ..... 374/208
4,132,114 A * 1/1979 Shah et al. ..... 374/144
5,366,290 A * 11/1994 Mayer et al. ..... 374/131
5,661,251 A * 8/1997 Cummings et al. ..... 73/866.5

* cited by examiner

*Primary Examiner*—Gary F. Paumen
*Assistant Examiner*—Felix O. Figueroa
(74) *Attorney, Agent, or Firm*—Nath & Associates PLLC; Gary M. Nath; Todd L. Juneau

(57) ABSTRACT

An adapter for enabling the installation of a Type II EGT probe that is normally mounted in a Type II jet engine, on a Type I jet engine instead of a Type I EGT probe, has a rim defining a through aperture and is mountable on the Type I jet engine instead of a Type I EGT probe. The Type II EGT probe has probe connectors for connection to an electrical harness and is mounted on the adapter so that the probe connectors are accessible via the aperture for connection to its associated electrical harness. The Type II EGT probe is mounted on the adapter so as to be oriented on the Type I jet engine in substantially the same orientation as it is normally mounted in a Type II jet engine.

8 Claims, 4 Drawing Sheets

ADAPTER FOR USE IN EGT MEASUREMENT OF A JET ENGINE

FIELD OF THE INVENTION

The invention is in the field of the measurement of the Exhaust Gas Temperature (EGT) of a jet engine.

BACKGROUND OF THE INVENTION

The Exhaust Gas Temperature (EGT) of a jet engine is measured by one or more EGT probes connected to a central EGT measurement control circuit via an electrical harness. Different jet engines and even different models of the same jet engine have different types of EGT probes and EGT electrical harnesses, thereby requiring an airline or a jet engine maintenance shop to keep a considerable inventory of EGT associated spare parts for maintenance purposes.

SUMMARY OF THE INVENTION

In accordance with the present invention, there is provided an adapter for enabling the installation of a Type II EGT probe instead of a Type I EGT probe on a Type I jet engine. the Type II EGT probe having probe connectors for connection to an electrical harness, the adapter having a rim defining a through aperture, the adapter being mountable on the Type I jet engine instead of a Type I EGT probe and capable of having the Type II EGT probe mounted thereon whereupon the Type II EGT probe is mounted on the Type I jet engine in substantially the same orientation as it is normally mounted on a Type II jet engine and its probe connectors are accessible via said aperture for connection to its associated electrical harness.

The present invention is based on the realization that if a Type I model of a jet engine can be effectively converted into a Type II model thereof without necessitating engine removal, tear down, and part replacement except for its EGT probes and its associated EGT electrical harnesses, then it is sufficient to have Type II EGT probes and Type II electrical harnesses in stock for use with either Type I or II jet engines as the need arises. The requirements for the effective conversion of a Type I model of a jet engine to a Type II model thereof are as follows: First, a jet engine is available in two models which are identical in every respect except that they have different types and possible number of EGT probes. Second, that the same number of EGT probes employed in a Type II model of a jet engine can replace the original EGT probes in a Type I model to assume substantially the same positions therein as in a Type II model such that an EGT reading yielded in accordance with the Type II EGT configuration is still acceptable in terms of determining the serviceability of the Type I jet engine. One such jet engine which complies with these requirements is the Pratt and Whitney JT9D-7A jet engine which is available in a first model with four Typical Part No. 777925 EGT probes and four Typical Part No. 777928 EGT probes making a total of eight EGT probes and in a second model with six Typical Part No. 761366 EGT probes. Other such jet engines which comply to these requirements include inter alia JT9D-7, JT9D-7H, JT9D-7AH, and JT9D-F.

The present invention also affords another advantage in that the effective conversion of a Type I jet engine to a Type II jet engine may render a higher EGT margin for extending its serviceability, however, without compromising safety considerations to any extent, if at all. Still further, the present invention facilitates back-to-back comparative testing of the same Type I jet engine once with a Type I EGT configuration and once with a Type II EGT configuration, thereby enabling accurate troubleshooting of EGT spread discrepancies by identifiing causes in certain areas of the burners and/or the fuel nozzles, and suitable corrective action.

BRIEF DESCRIPTION OF THE DRAWINGS

In order to understand the invention and to see how it may be carried out in practice, a preferred embodiment will now be described, by way of a non-limiting example only, with reference to the accompanying drawings, in which similar parts are likewise numbered, and in which.

DETAILED DESCRIPTION OF THE DRAWINGS

Figure 1A:
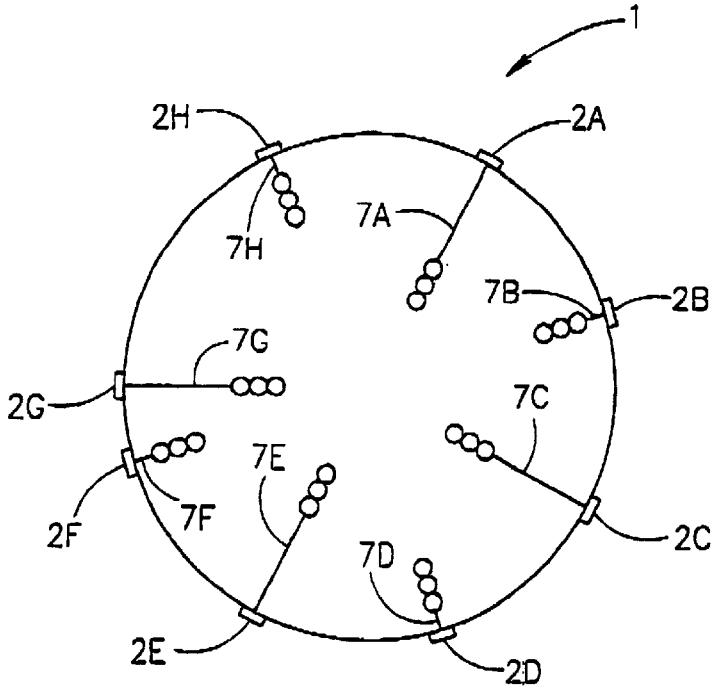
FIG.1A (PRIOR ART)
FIG. 1A is a transverse cross section view of the Low Pressure Turbine (LPT) of a Type I Pratt and Whitney JT9D-7A jet engine with eight Type I EGT probes.
Figure 1B:
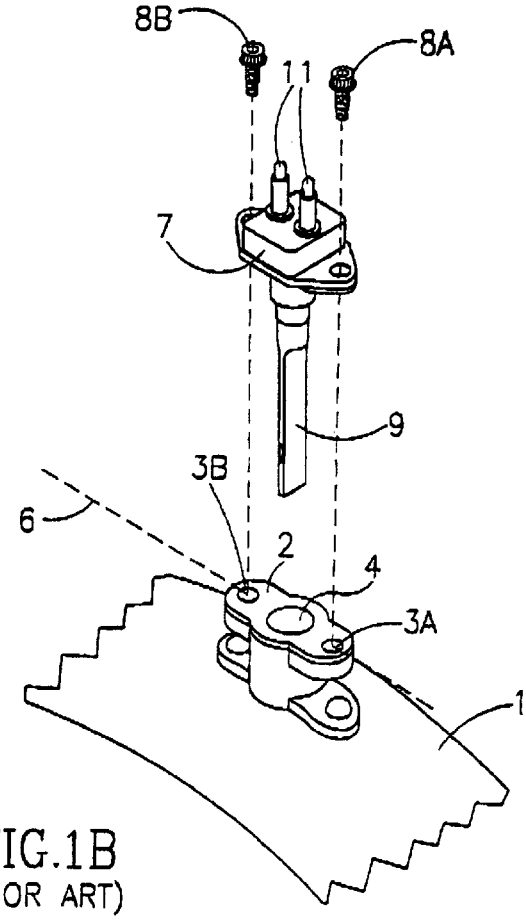
FIG.1B (PRIOR ART)
FIG. 1B is a perspective view showing the mounting of a Type I EGT probe on a Type I Pratt and Whitney JT9D-7A jet engine.

With reference now to FIGS. 1A and 1B, a Pratt and Whitney JT9D-7A jet engine (constituting a so-called Type I model) has a Low Pressure Turbine (LPT) 1 fitted with eight Type I EGT probe bosses 2A–2H and eight Type I EGT probes 7A–7H peripherally disposed thereabout. A probe boss 2 is elongated and has a pair of spaced apart through holes 3A and 3B laterally disposed relative to a central through hole 4, and is mounted such that its longitudinal axis 6 is circumferentially disposed relative to the LPT 1. A Type I EGT probe 7 is mounted on each of the probe bosses 2A–2H by means of a pair of fastening screws 8A and 8B such that its probe end 9 is inserted through the through hole 4 into the plenum of the LPT 1 and its probe connectors 11 are accessible for connection of a Type I EGT electrical harness (not shown).

Figure 2A:
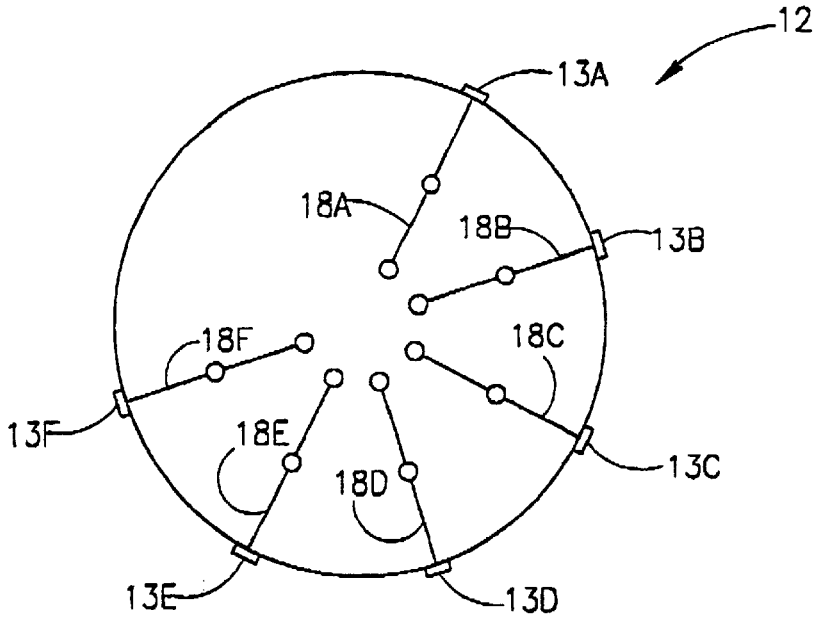
FIG.2A (PRIOR ART)
FIG. 2A is a transverse cross section view of the Low Pressure Turbine (LPT) of a Type II Pratt and Whitney JT9D-7A jet engine with six Type II EGT probes.
Figure 2B:
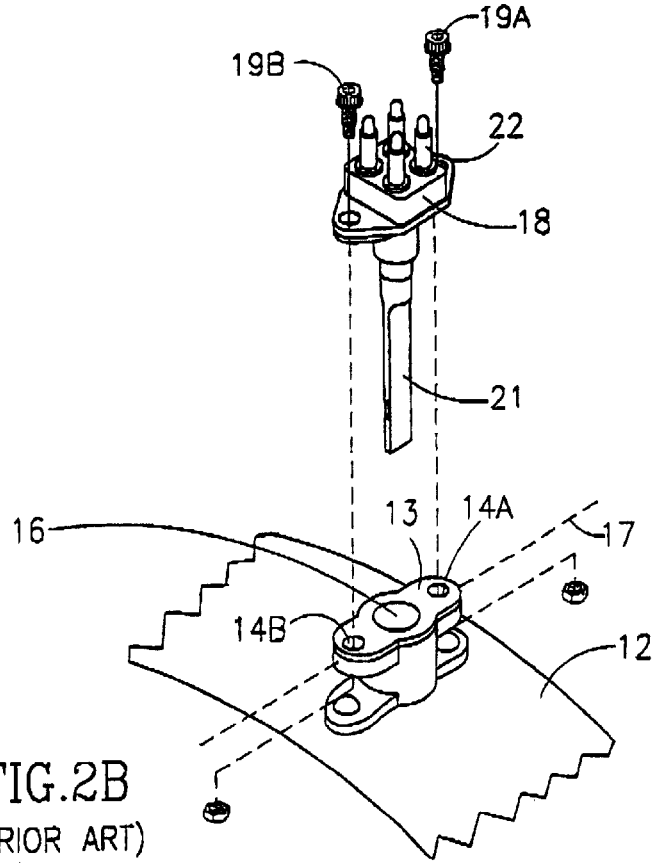
FIG.2B (PRIOR ART)
FIG. 2B is a perspective view showing the mounting of a Type II EGT probe on a Type II Pratt and Whitney JT9D-7A jet engine.
Figure 3:
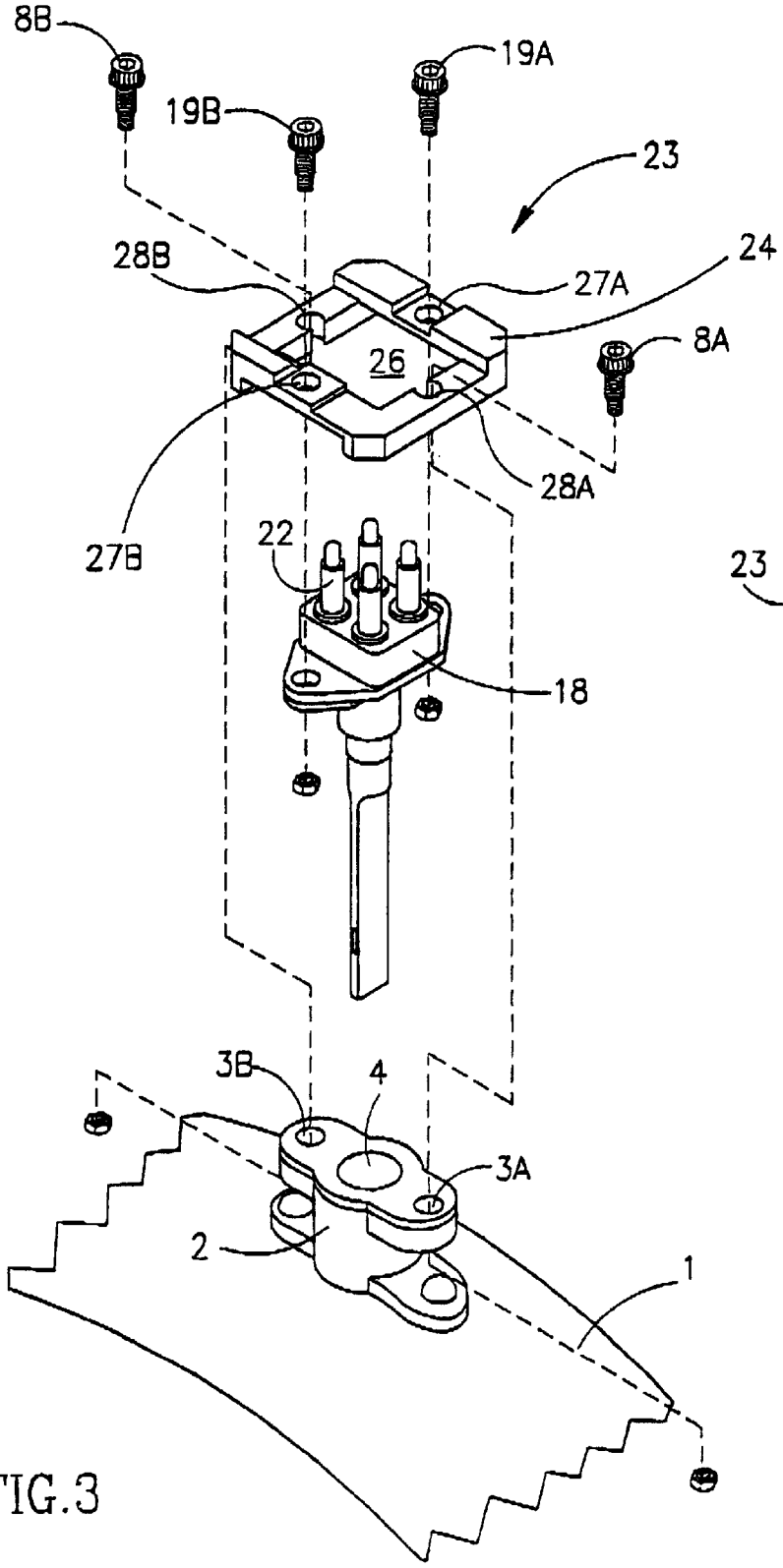
FIG. 3 is an exploded view showing the mounting of a Type II EGT probe on a Type I Pratt and Whitney JT9D-7A jet engine.
Figure 4:
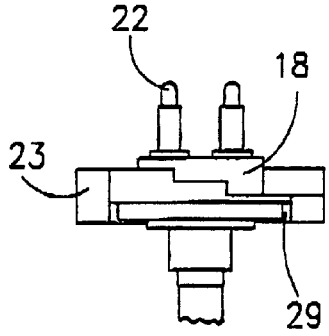
FIG. 4 is a side view of an adapter of the present invention with a Type II EGT probe mounted therein.
Figure 5:
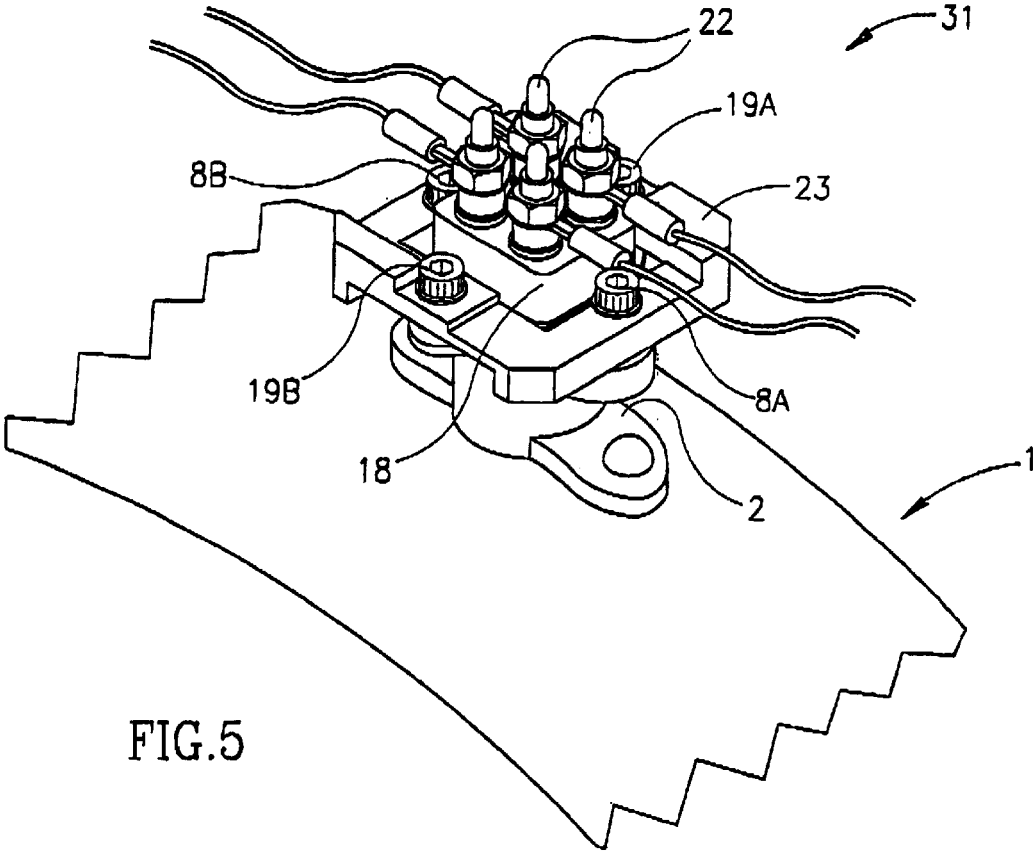
FIG. 5 is an assembled view of a Type II EGT probe on a Type I Pratt and Whitney JT9D-7A jet engine.

Turning now to FIGS. 2A and 2B, a Pratt and Whitney JT9D-7A jet engine (constituting a so-called Type II model) has a Low Pressure Turbine (LPT) 12 fitted with six Type II EGT probe bosses 13A–13F and six Type II EGT probes 18A–18F peripherally disposed thereabout. A probe boss 13 is elongated and has a pair of spaced apart through holes 14A and 14B laterally disposed relative to a central through hole 16, and is mounted such that its longitudinal axis 17 is directed along the longitudinal axis of the LPT 12. The probe bosses 13A–13F are located in the same peripheral positions as the probe bosses 2A–2F, however, their longitudinal axes 17 are rotated through 90° with respect to the longitudinal axes 6 of the probes bosses 2A–2F. A Type II EGT probe 18 is mounted on each of the probe bosses 13A–13F by means of a pair of fastening screws 19A and 19B such that its probe end 21 is inserted through the through hole 16 into the plenum of the LPT 12 and its probe connectors 22 are accessible for connection of a Type II EGT electrical harness (not shown).

Figure 6:
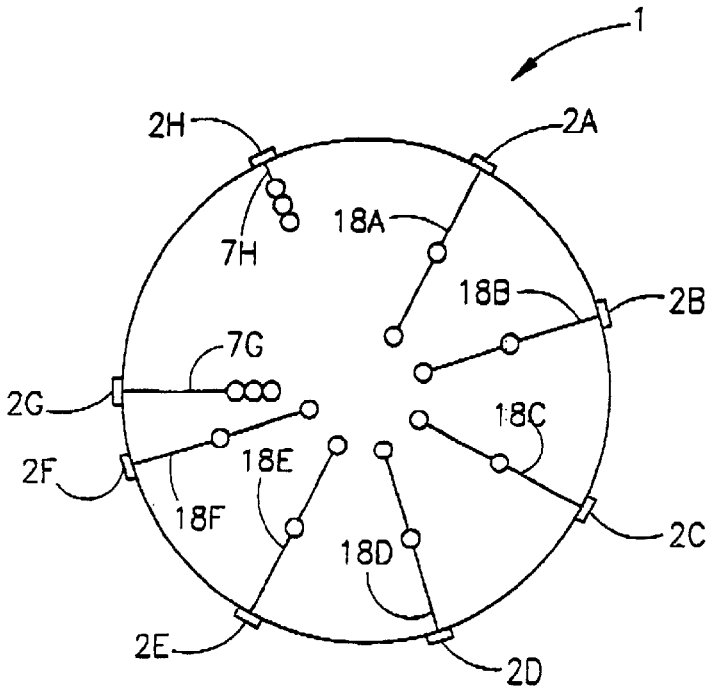
FIG. 6 is a transverse cross section view of the LPT of FIG. 1 after its effective conversion to a Type II Pratt and Whitney JT9D-7A jet engine.

Turning now to FIGS. 3–6, an adapter 23 has a rim 24 defining a through aperture 26, a first pair of diametrically opposite fixation holes 27A and 27B and a second pair of diametrically opposite fixation holes 28A and 28B. The adapter 23 is formed with a channel 29 for receiving a Type II EGT probe 18 from its underside whereupon the adapter 23 and the Type II EGT probe 18 have substantially flush lower surfaces (see FIG. 4). The Type II EGT probe 18 is fastened to the adapter 23 by means of the pair of fastening screws 19A and 19B passing through the pair of fixation holes 27A and 27B. The adapter 23 is securely mounted on a probe boss 2 in a similar manner as the Type I EGT probe 7 (shown in FIG. 1B) by means of the pair of fastening screws 8A and 8B passing through the fixation holes 28A and 28B. On mounting the Type II EGT probe 18 on the probe boss 2 by way of the adapter 23, its probe end 21 is inserted through the through hole 4 into the plenum of the LPT 1 in a similar fashion when mounted on the LPT 12 and its probe connectors 22 are accessible for connection of a Type II EGT electrical harness 31 (see FIG. 5). FIG. 6 shows how a fully converted LPT 1 may be arranged with six Type II EGT probes 18A–18F mounted on the probe bosses 2A–2F using the adapter 23 (not shown) for each probe boss 2A–2F and two original Type I EGT probes 7G and 7H mounted on the probe bosses 2G and 2H.

while the invention has been described with respect to a limited number of embodiments, it will be appreciated that many variations, modifications and other applications of the invention can be made within the scope of the appended claims.

What is claimed is:

1. An adapter in combination with an engine probe with first holes and an engine having a housing with second holes, the adapter comprising a rim defining an aperture, at least two first diametrically opposite fixation holes defining a first axis passing through said first diametrically opposite fixation holes located on said rim for mounting said engine probe to the adapter, and at least two second diametrically opposite fixation holes defining a second axis passing through said second diametrically opposite fixation holes located on said rim and circumferenitially spaced apart from said first fixation holes for mounting said adapter to said housing, wherein in said combination the engine probe is inserted via said aperture so that said first holes of the engine probe are aligned with said first fixation holes and said second holes of the housing are aligned with said second fixation holes;

wherein said second axis is transverse to said first axis.

2. An adapter according to claim 1, designed for installation of a Type II EGT probee on a Type I engine.

3. An adapter according to claim 1, wherein said housing includes a probe boss formed with said second holes and the adapter is designed to be mounted to said probe boss by said second holes.

4. The adapter according to claim 1, wherein the rim is formed with a channel on a side of the rim facing the housing when the adapter is mounted thereon, for receiving the engine probe, whereupon the adapter and the engine probe have substantially flush lower surfaces.

5. An assembly comprising:

an engine probe of Type II with first holes;

an engine of Type I having a housing with second holes;

an adapter having a rim defining an aperture, at least two first diametrically opposite fixation holes located on said rim for mounting said probe to the adapter, and at least two second diametrically opposite fixation holes located on said rim circumferentially spaced apart and angularly offset from said first fixation holes for mounting said adapter to said housing, wherein upon assembling, the engine probe is inserted via said aperture and is mounted on said adapter so that said first holes of the engine probe are aligned with said first fixation holes of the adapter and the adapter is mounted on the housing so that said second holes of the housing are aligned with said second fixation holes of the adapter.

6. An assembly according to claim 5, wherein said housing includes a probe boss formed with said second holes.

7. An assembly according to claim 5, wherein the rim is formed with a channel on a side of the rim facing the housing when the adapter is mounted thereon, for receiving the engine probe whereupon the adapter and the engine probe have substantially flush lower surfaces.

8. An assembly according to claim 5, wherein said at least two second diametrically opposite fixation holes are circumferentially spaced apart from said first fixation holes.

* * * * *